US008668318B2

(12) United States Patent
Chappell et al.

(10) Patent No.: US 8,668,318 B2
(45) Date of Patent: Mar. 11, 2014

(54) SYSTEM AND METHOD FOR SPREADING INK ON A MEDIA WEB

(75) Inventors: James M. Chappell, Webster, NY (US); Jason M. LeFevre, Penfield, NY (US); James E. Williams, Penfield, NY (US); Paul McConville, Webster, NY (US); Paul S. Bonino, Ontario, NY (US); James Spence, Honeoye Falls, NY (US); Roger G. Leighton, Hilton, NY (US); Michael F. Leo, Penfield, NY (US); Joseph C. Sheflin, Macedon, NY (US); Michael J. Levy, Webster, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 29 days.

(21) Appl. No.: 13/558,661

(22) Filed: Jul. 26, 2012

(65) Prior Publication Data

US 2014/0028747 A1 Jan. 30, 2014

(51) Int. Cl.
*B41J 2/175* (2006.01)
*B41J 2/01* (2006.01)

(52) U.S. Cl.
USPC ..... 347/88; 347/103

(58) Field of Classification Search
CPC ..... B41J 2/17593; B41J 11/002
USPC ..... 347/12, 16–18, 88, 101, 103, 104
See application file for complete search history.

(56) References Cited

U.S. PATENT DOCUMENTS

| | | | | |
|---|---|---|---|---|
| 5,436,711 | A | 7/1995 | Hauser | |
| 6,122,480 | A | 9/2000 | Hwang | |
| 6,161,930 | A | 12/2000 | Asano | |
| 6,494,570 | B1 | 12/2002 | Snyder | |
| 6,725,010 | B1 | 4/2004 | Parker | |
| 7,151,903 | B2 | 12/2006 | Wu et al. | |
| 7,549,635 | B2 | 6/2009 | Nakashima | |
| 7,828,423 | B2 | 11/2010 | Larson et al. | |
| 8,152,288 | B2 * | 4/2012 | Williams et al. | 347/88 |
| 2007/0120930 | A1 | 5/2007 | Domoto et al. | |
| 2008/0017062 | A1 | 1/2008 | Seyfried | |

(Continued)

FOREIGN PATENT DOCUMENTS

| | | | |
|---|---|---|---|
| EP | 0 938 974 | A2 | 9/1999 |
| EP | 1 533 129 | A1 | 5/2005 |
| JP | 20-26747 | A | 1/1990 |

OTHER PUBLICATIONS

European Search Report corresponding to European Patent Application No. EP 08 159 751, European Patent Office, Munich, Germany, Oct. 6, 2008 (6 pages).

*Primary Examiner* — An Do

(74) *Attorney, Agent, or Firm* — Maginot, Moore & Beck, LLP

(57) ABSTRACT

A leveling and spreading system has been developed that enables the speed and position of the web to be determined from a sensor on a first roller. In a duplex print process, the first roller also reduces a temperature of the media web and an ink image printed in the first side print operation to within a first predetermined temperature range. A second roller modulates the temperature of the media web and ink ejected onto the media web immediately before the web enters the leveling and spreading system to within a second predetermined temperature range to enable uniformity of the ink and web temperatures for spreading the ink in a nip formed with a third roller.

23 Claims, 2 Drawing Sheets

(56) References Cited

U.S. PATENT DOCUMENTS

| | | | |
|---|---|---|---|
| 2008/0170901 | A1 | 7/2008 | Yi |
| 2008/0248196 | A1 | 10/2008 | Anderson et al. |
| 2009/0141110 | A1 | 6/2009 | Gervasi et al. |
| 2009/0160920 | A1 | 6/2009 | Badesha et al. |
| 2010/0045720 | A1 | 2/2010 | Williams et al. |
| 2011/0063355 | A1 | 3/2011 | Eun et al. |
| 2011/0063357 | A1 | 3/2011 | Eun et al. |
| 2011/0109683 | A1 | 5/2011 | Williams et al. |
| 2011/0148973 | A1 | 6/2011 | Chappell et al. |
| 2011/0199414 | A1 | 8/2011 | Lang |
| 2011/0228024 | A1 | 9/2011 | Lang et al. |
| 2011/0252992 | A1 | 10/2011 | Viturro et al. |
| 2011/0273502 | A1 | 11/2011 | Eun et al. |
| 2011/0304665 | A1 | 12/2011 | Mantell |
| 2011/0315031 | A1 | 12/2011 | Yang et al. |
| 2012/0113176 | A1 | 5/2012 | Folkins et al. |

* cited by examiner

SYSTEM AND METHOD FOR SPREADING INK ON A MEDIA WEB

TECHNICAL FIELD

The present disclosure relates to printers, and, more particularly, to apparatus that fix marking material to media in such printers.

BACKGROUND

In general, inkjet printers include at least one printhead that ejects drops of liquid ink onto an image receiving surface. The liquid ink can then be ejected directly onto a media surface, or the ink can be ejected onto a surface of an intermediate imaging member and then transferred to media. Some inkjet printers use phase change inks that are in a solid phase at ambient temperature, but transition to a liquid phase at an elevated temperature. The ink droplets solidify to form an image once the ejected ink is on an image receiving surface.

The media in both direct and offset printing architectures can be a continuous media web. In a web printer, a continuous supply of media, typically provided in a media roll, is conveyed by a plurality of rollers that are arranged to guide the media web through a print zone, where a plurality of printheads are positioned to deposit ink onto the web to form images. Beyond the print zone, the media web is gripped and pulled by mechanical structures to enable a portion of the media web to continuously move through the print zone. Tension bars or rollers may be placed in the feed path of the moving web to remove slack from the web to ensure that the web remains taut without breaking.

In continuous-web, direct-to-media printing, a fixing assembly is used after the ink is ejected onto the web to fix the ink to the web. The fixing assembly used depends on the type of ink. For example, when using melted phase change ink to form images, the fixing assembly may include a pair of rollers that defines a nip for applying pressure to the ink and web to spread the ink on the web as the web passes through the nip. The function of the pair of rollers, also referred to herein as a spreader, is to transform a pattern of ink drops deposited onto a web by flattening and spreading the ink drops to make a more uniform and continuous layer. The spreader uses pressure and heat to reduce the height of the ink droplets and fill the spaces between adjacent drops.

One difficulty faced in the operation of the spreader is providing the web and the ink deposited on the web to the spreader at a temperature that enables the ink deposited on the web to be spread uniformly for high image quality. Due to very fast processing speeds at which some continuous feed imaging devices operate, the ink deposited on the web at the print station may be above a suitable temperature range as the image passes through the nip. This high ink temperature results in the ink bleeding into the web and possibly showing through to the opposite side of the media web. Conversely, if the ink cools below the suitable temperature range prior to reaching the spreader, the ink may not be malleable enough to allow for sufficient line spread or adherence to the web. In addition, the ink ejected by the printheads is generally much hotter than the print medium, and, consequently, areas imaged with high ink coverage may exit from the print zone at higher temperatures than the areas of the media web where little or no ink was ejected. Ink that enters the spreader at varying temperatures can cause inconsistent and non-uniform line spread on the web, reducing image quality. Thus, improved media and ink temperature equalization is desirable.

SUMMARY

In one embodiment a printing system spreads ink drops on a media web that better preserve image quality. The system includes a first roller, a second roller, a third roller, a sensor, and a controller. The first roller is substantially comprised of thermally conductive material and configured to maintain a first predetermined temperature. The first roller is positioned to enable a first side of a media web to contact a portion of a circumference of the first roller for a first predetermined dwell time after a plurality of ink drops have been ejected onto a second side of the media web to enable conductive heat transfer between the first side of the media web contacting the portion of the circumference of the first roller and the first roller to reduce a temperature of the first side of the media web contacting the first roller to within a first predetermined range about a second predetermined temperature. The second roller is formed of thermally conductive material and configured to maintain a third predetermined temperature. The second roller is positioned to engage the second side of the media web after the temperature of the first side of the media web has been reduced by the first roller to enable the second side of the media web and the ink drops ejected onto the second side to contact a portion of a circumference of the second roller for a second predetermined dwell time to enable conductive heat transfer between the media web and ink drops contacting the portion of the circumference of the second roller and the second roller to modulate a temperature of the media web and the ink drops on the media web contacting the second roller to within a second predetermined range about a fourth predetermined temperature. The third roller is positioned to form a nip with the second roller and configured to apply pressure to the media web as the media web is transported through the nip to spread the ink drops on the second side of the media web after the temperature of the media web and the ink drops on the media web contacting the second roller are within the second predetermined range about the fourth predetermined temperature. The sensor is configured to generate an electrical signal indicating an angular velocity of the first roller. The controller is operatively connected to the sensor and configured to identify a position and a velocity of the media web with reference to the electrical signal indicating angular velocity of the first roller received from the sensor, and to operate a plurality of inkjet ejectors to eject ink drops onto the media web with reference to the identified position and velocity of the media web.

In another embodiment a method of spreading ink drops on a media web better preserves image quality. The method comprises maintaining a first roller at a first predetermined temperature, contacting a portion of a circumference of the first roller with a first side of a media web for a first predetermined dwell time after a plurality of ink drops have been ejected on a second side of the media web to enable conductive heat transfer between the first side of the media web contacting the portion of the circumference of the first roller and the first roller to reduce a temperature of the first side of the media web contacting the portion of the circumference of the first roller to within a first predetermined range about a second predetermined temperature, maintaining a second roller at a third predetermined temperature; contacting a portion of a circumference of the second roller with the media web for a second predetermined dwell time to enable conductive heat transfer between the media web contacting the portion of the circumference of the second roller and the second roller to modulate a temperature of the media web and ink drops on the second side of the media web contacting the portion of the circumference of the second roller to within a second predetermined range about a fourth predetermined temperature, forming a nip with the second roller and a third roller, transporting the media web through the nip to spread the ink drops on the media web after the temperature of the media web and the ink drops on the media web contacting the portion of the circumference of the second roller are within the second predetermined range about the fourth predetermined temperature, and generating with a sensor operatively connected to the first roller an electrical signal indicating an angular velocity of the first roller.

In yet another embodiment a printer has been developed that better preserves image quality of prints. The printer comprises a first roller, a second roller, a third roller, and a sensor. The first roller is positioned between a printhead and a second roller. The first roller is configured to move a media web past the printhead and to reduce a temperature of a first side of the media web contacting the first roller to a first predetermined range about a first predetermined temperature. The sensor is operatively connected to the first roller and configured to generate an electrical signal indicating an angular velocity of the first roller. The second roller is positioned to move the media web from the first roller to the second roller and to modulate a temperature of the media web and ink drops on a second side of the media web contacting the second roller to a second predetermined range about a second predetermined temperature. The third roller is positioned to form a nip with the second roller and to apply pressure to the media web after the temperature of the media web and the ink drops on the second side of the media web contacting the second roller has been modulated to the second predetermined range about the second predetermined temperature to enable the ink drops ejected onto the second side of the media web by the printhead to be spread on the media web.

DETAILED DESCRIPTION

Figure 1:
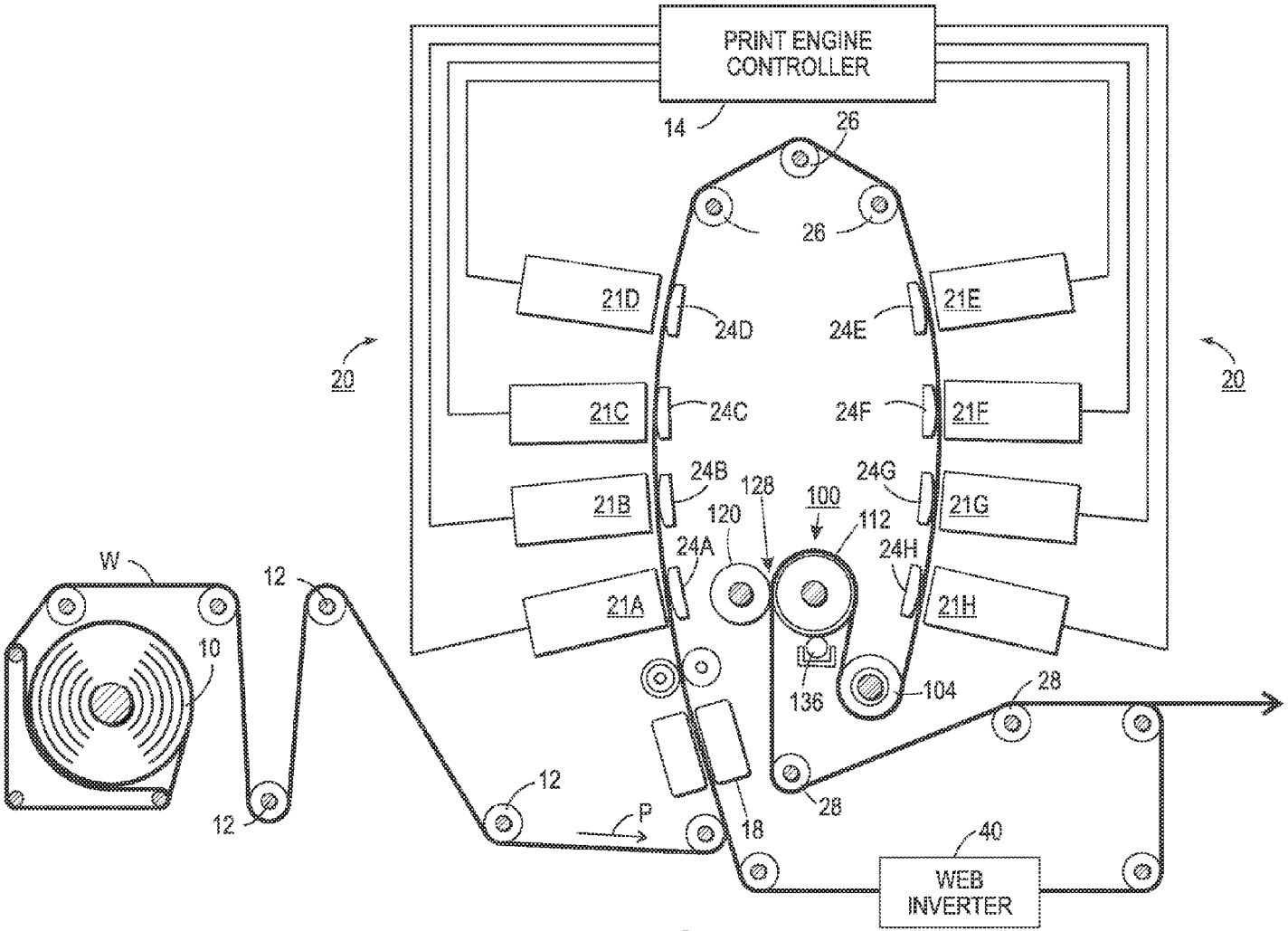
FIG. 1 is a simplified elevation view of a direct-to-media, continuous-web, phase-change ink printer.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, etc., which generates printed images for any purpose. The term "printhead" as used herein refers to a component in the printer that is configured with inkjet ejectors to eject ink drops onto an image receiving surface. A typical printhead includes a plurality of inkjet ejectors that eject ink drops of one or more ink colors in response to firing signals that operate actuators in the inkjet ejectors. The inkjets are arranged in an array of one or more rows and columns. In some embodiments, the inkjets are arranged in staggered diagonal rows across a face of the printhead. Additionally, one or more printheads can be arranged in a staggered configuration to print a line across a width of the image receiving surface as the image receiving surface moves past the printheads in the process direction. As used herein, the process direction is the direction in which an image receiving surface, for example, a media sheet or web, moves past the printheads and a cross-process direction is substantially perpendicular to the process direction in the plane of the image receiving surface.

FIG. 1 is a simplified elevational view of a direct-to-media, continuous-web, phase-change ink printer. A web supply and handling system is configured to supply a long, substantially continuous web W of substrate, for example paper, plastic, or other printable material, from a spool 10. The web W can be unwound as needed and propelled by a variety of motors (not shown). The web supply and handling system is capable of transporting the web W at a plurality of different speeds. A set of rollers 12 control the tension of the unwinding web as the web moves through a path. Also, at least one preheater 18 heats the web to an initial predetermined temperature before ink is ejected onto the web. The preheater 18 can rely on contact, radiant, conductive, or convective heat to bring the web W to a target preheat temperature, which, in one practical embodiment, is in a range of about 30° C. to about 70+C.

The web W is transported through a marking station 20 that is configured to deposit marking material onto the web to form images. In the embodiment of FIG. 1, the marking station includes a series of print box units 21A-21H, each of which can include a printhead or a plurality of printheads effectively extending across the width of the web and configured to eject ink of one color directly onto the moving web. In one embodiment the printer includes printheads that eject cyan, magenta, yellow, and black ink, although more, less, or different colors can be used in other embodiments. In the illustrated embodiment, the print box units 21A-21H are separated into two arrays of four print box units. The media web W passes through the first array of print box units 21A-21D and is directed to the second array of print box units 21E-21H by one or more apex rollers 26. Eight print box units are shown in FIG. 1, although any suitable number of print box units can be used. As is generally familiar, a print engine controller 14 sends rendered image data to a controller for each of the print box units 21A-21H and the print engine controller generates firing signals that operate the inkjets in the printhead. In the printer of FIG. 1, each printhead ejects ink for a color separation for one color of ink on overlapping areas on the web W. These color separations combine to form a single color image. In various possible embodiments, the single print box unit can be implemented with a plurality of printheads, which are typically arranged in a staggered configuration to enable the multiple printheads to eject a portion of a color separation for one of the colors used in the printer. Other possible arrangements of printheads and print box units are possible.

In one embodiment, the marking material applied to the web is a phase-change ink, by which is meant that the ink is substantially solid at room temperature and substantially liquid when heated to a phase change temperature. The phase-change inks are heated above a melting temperature to a suitable printing temperature, which can be about 80° C. to 140° C., and jetted onto the web W. In alternative embodiments other suitable marking material or ink can be used including, for example, ultraviolet (UV) curable, gel, or emulsified ink.

Each printhead includes a backing member 24A-24H, typically in the form of a bar or roll. These bars are arranged on the opposite side of the web W from each printhead 21A-21H. Each backing member is used to position the web W to enable the gap between the printhead and the sheet to remain at a known, constant distance that is suitable for printing. Each backing member can include a heating element to enable the adjacent portion of the web to reach a predetermined ink-receiving temperature, which, in one practical embodiment, is in a range of about 30° C. to about 70° C.

As the web moves through the printing station 20 to receive inks of various colors, the temperature of the web is maintained within a given range. Ink is jetted at a temperature that is significantly higher than the temperature of the web. Thus, the ink heats a portion of the web near where ink is ejected. The members in contact with or near the web in zone 20 are therefore adjusted to maintain the desired web temperature. For example, the backing members and the air flow around the web can affect the web temperature. Accordingly, air blowers or fans can be utilized to facilitate regulation of the web temperature.

Figure 2:
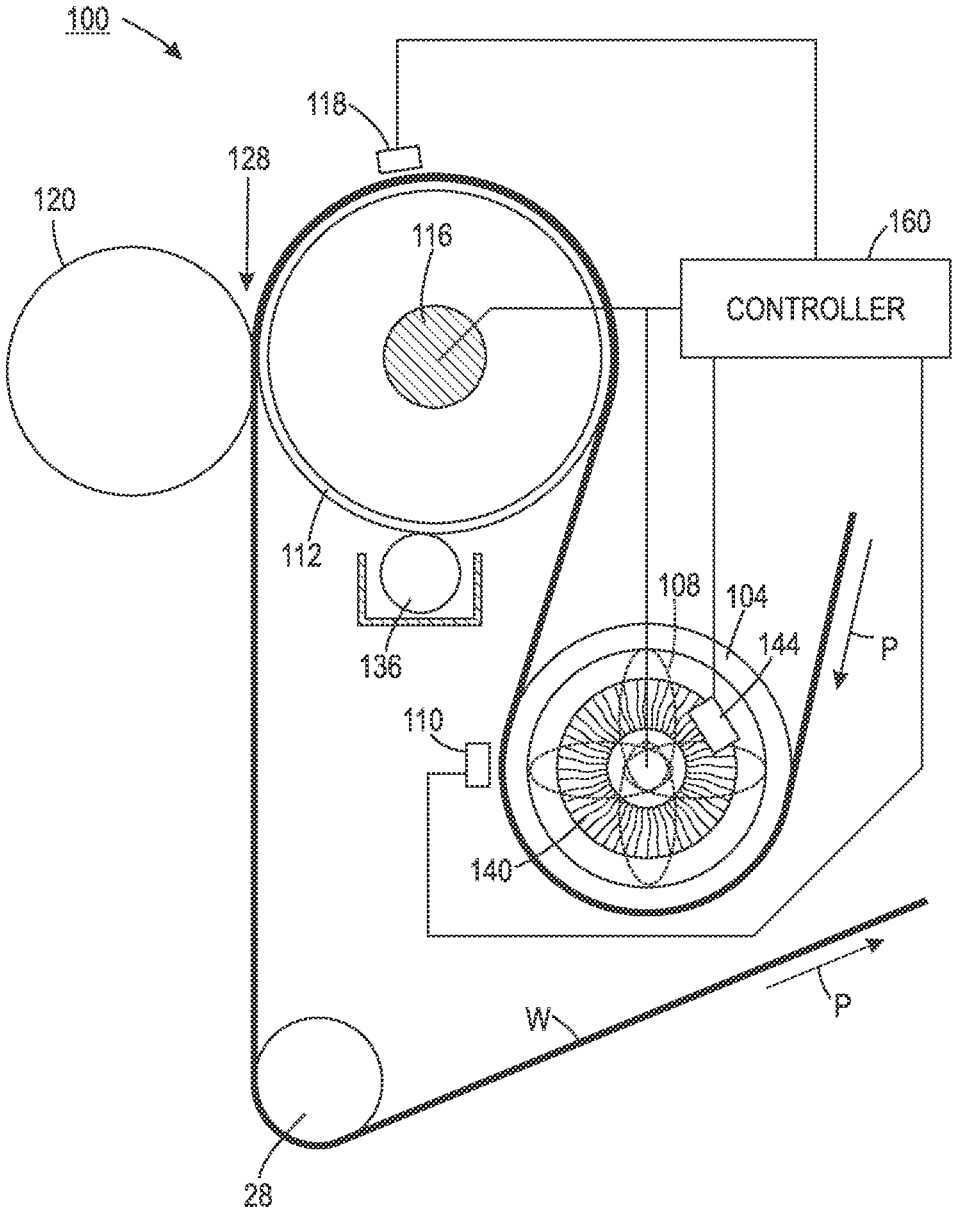
FIG. 2 is a schematic view of an ink spreading system for use with the imaging device of FIG. 1.

Following the printing zone 20, along the path of web W, is a spreader assembly 100. With reference to FIG. 2 and continuing reference to FIG. 1, the spreader assembly 100 includes a encoder roller 104, a leveler roller 112, a pressure roller 120, and a controller 160. The web W is configured to move in the process direction P to contact a portion of the circumference of the encoder roller 104, a portion of the circumference of the leveler roller 112, and then pass through a nip formed between the leveler roller 112 and the pressure roller 120.

The encoder roller 104 is formed of a thermally conductive material to enable the encoder roller 104 to conduct heat from the web W as the web W contacts the portion of the circumference of the encoder roller 104. In one embodiment the encoder roller substantially comprises anodized aluminum impregnated with polytetrafluoroethylene (commonly referred to as PTFE and sold commercially as Teflon®) to prevent ink and other particles from adhering to the roller. The encoder roller 104 includes an optical encoder disk 140, an optical encoder sensor 144, a fan 108, and a temperature sensor 110. The fan 108 is operated to move air through the encoder roller 104 to maintain the encoder roller 104 at a predetermined temperature. The temperature sensor 110 is configured to sense the temperature of the encoder roller 104 and generate an electronic signal that is delivered to the controller 160, enabling the controller 160 to selectively operate the fan to maintain the temperature of the encoder roller 104 at the predetermined temperature. In one embodiment, the predetermined temperature of the encoder roller 104 is between about 40 and about 45 degrees C., although the encoder roller temperature can vary in other embodiments depending on the contact time of the media web on the roller, the temperature of the web and ink, and the properties of the media web and ink. In other practical embodiments a liquid cooling system, a heat sink, or a combination of fans, liquid cooling, and heat sinks can be used to cool the encoder roller. In some embodiments the encoder roller can be provided with a heater to enable more precise temperature control, particularly during printer start-up.

The angular velocity and position of the encoder roller 104 is monitored by a sensor, which, in the illustrated embodiment, comprises optical encoder disk 140 and optical sensor 144. The optical encoder disk 140 is axially mounted to the encoder roller 104 and configured to rotate with the encoder roller 104. The optical sensor 144 remains stationary with respect to the rotating encoder disk 140 and is configured to direct a beam of light through the spinning disk 140. The optical encoder disk 140 has a plurality of spokes extending axially from the center of the disk, which interrupt the light beam generated in the sensor 144 as the encoder roller 104 and optical encoder disk 140 rotate past the sensor 144. The sensor 144 generates signals corresponding to the interruptions in the light beam, which identify the angular velocity and rotational position of the encoder roller 104. In another embodiment, the optical encoder disk includes a predetermined pattern of light and dark segments that alter the reflection of light from the surface of the optical disk to the sensor as the optical encoder rotates. In still another embodiment, the sensor on the encoder roller comprises a Hall Effect sensor.

The leveler roller 112 is positioned to contact the media web W after the media web W contacts the portion of the circumference of the encoder roller 104. The leveler roller 112 includes a heater 116, a temperature sensor 118, and a cleaning and oiling station 136. The temperature sensor 118 generates an electronic signal indicative of the temperature of the leveler roller 112 to enable operation of the heater 116 to maintain the leveler roller 112 at a second predetermined temperature, which, in one embodiment, is in a range between about 53 and about 55 degrees C. The cleaning and oiling station 136 is suitable for cleaning residual ink and other particles from the leveler roller 112 and/or applying a layer of lubricant, release oil or other material to the surface of the leveler roller 112. The oil applied to the leveler roller 112 facilitates removal of the ink from the leveler roller 112 and prevents ink drops from adhering to the leveler roller instead of the media web W. Station 136 can, for example, coat the surface of the leveler roller 112 with a lubricant, such as amino silicone oil, which has a viscosity of about 10-200 centipoises.

The pressure roller 120 is arranged to contact the leveler roller 112 to define a nip 128 through which the web W is fed after the web has been heated by the leveler roller 112. The pressure roller 120 is configured to apply pressure to the web W and the ink on the web W as the web passes through the nip 128 to spread drops of ink on the web W. Spreading the drops fills the spaces between adjacent drops, improving uniformity of the printed solids in the image. In addition to spreading the ink, the pressure roller 120 improves image permanence by increasing the ink layer cohesion and the ink-web adhesion. The pressure at the nip 128 between the leveler roller 112 and the pressure roller 120 can be any suitable pressure that enables ink drop or line spreading on the web to achieve desired image quality. In one practical embodiment, the nip pressure at the spreading nip 128 is set in a range of about 500 psi to about 2000 psi, although the nip pressure can be higher or lower depending on the ink characteristics, spreading temperature, and desired image quality. In some embodiments, the pressure roller can be configured with a heater and a temperature sensor to enable the pressure roller to be maintained at a predetermined temperature and apply heat to the web as the ink is spread in the nip.

The heater 116 in the leveler roller 112 includes one or more heating elements disposed inside a hollow core of the roller to generate thermal energy in the roller. The heater in the core can comprise a heating lamp, for example, a quartz, carbon filament, or halogen lamp. In other embodiments, the leveler roller temperature is maintained with a fluid that flows through the roller and is heated by an external device. The heater 116 is configured to heat the leveler roller 112 in accordance with an electrical current provided by one or more heater power supplies (not shown). Although internal heating components have been described for heating the leveler roller, the leveler roller can be heated by external radiant or convective heaters or a combination of internal and external heaters. The heater 116 is controlled to heat the leveler roller 112 to an operating temperature that is suitable for spreading the ink on the web W in the nip 128.

After the web W passes through the nip 128, the media web W continues in the process direction P toward a web inverter 40 (FIG. 1) or rewind station (not shown). One or more guide rollers 28 can be positioned to direct the media web toward the inverter 40 or rewind station while keeping the media web under tension. In a duplex web printer, the web inverter 40 is configured to invert the media web after a first side of the web has been printed to enable the web to be directed through the print zone a second time to print on a second side of the media web.

For optimum spreader performance, ink and web temperatures are substantially equalized prior to entering the nip 128 to within a target temperature range that promotes adherence of the melted ink to the web, minimizes visibility of printed ink from the opposite side of the media ("show-through"), maximizes ink dot spread, and reduces image defects on the opposite side of the media in a duplex printing process. The target temperature range for the ink and web prior to entering the nip 128 can also be referred to as the pre-spreading temperature range. In one embodiment, the pre-spreading temperature range is between about 50° C. and about 55° C. The pre-spreading temperature range, however, can be any suitable range of temperatures suitable for spreading ink on a web depending on factors such as the ink formulation, web substrate material, web velocity, and the like.

The media web W is configured to exit the printing station 20 and proceed to the encoder roller 104, where the web W contacts a portion of the circumference of the encoder roller 104. The encoder roller 104 is configured to contact the side of the media web W that was not immediately printed by the printing station 20 on the most recent pass by the printing station. Thus, in a duplex printing process the first side of the media web W on which an ink image was ejected in the first side printing operation contacts the encoder roller 104 after the second side is printed by the printing station. In the printing station 20, the ink on the first printed side of the media web W is heated by ink applied to the second side of the media web W. Contact with the encoder roller 104 cools the ink on the first printed side of the media web W before the second side ink image is spread, avoiding image defects that may result from passing the first side ink image through the nip when the temperature of the first side ink image is too high.

The speed at which the web W moves through the printer, the size of the encoder roller 104, and the portion of the encoder roller circumference contacting the web define a first dwell time, which represents the amount of time a given portion of the media web W, and, in a duplex print process, the ink image on the first side of the media web, are in contact with the encoder roller 104. The first dwell time, along with the temperature of the web and encoder roller, controls the amount of heat transfer that occurs between the encoder roller 104 and the ink image on the first side of the media web W. A greater first dwell time enables more heat to transfer from the ink image and web W to the encoder roller 104. In one practical embodiment with a encoder roller at approximately 40 degrees C., the first predetermined dwell time is approximately 80 milliseconds, and is configured to reduce the temperature of the ink image on the first side of the media web by approximately 10° C., from about 55° C. to about 45° C.

After the media web W passes the encoder roller 104, the web W is transported to the leveler roller 112. In both a simplex and a duplex printing process, the leveler roller 112 contacts the side of the media web W and the ink that was immediately printed by the printing station 20 on the most recent pass by the printing station to cool the recently applied ink. The leveler roller 112 contacts the web W for a second predetermined dwell time, which is defined by the speed of the web, the portion of the circumference of the leveler roller 112 contacted, and the size of the leveler roller 112. In the illustrated embodiment, the media web wraps around a portion of the circumference of the leveler roller that is greater than half of the circumference of the leveler roller. In other embodiments, the media web can be configured to wrap around a greater or a lesser portion of the circumference of the leveler roller. The second dwell time, the temperature of the web W, and the temperature of the leveler roller 112 control the amount of heat transfer that occurs between the leveler roller 112 and the ink on the media web W. In one embodiment, a leveler roller that is approximately 53-55 degrees C., with a second predetermined dwell time of approximately 160 milliseconds, modulates the temperature of the web and ink on the web to a pre-spreading temperature range of approximately 50-55 degrees C. Once the media web W and the ink on the web W have leveled to within the pre-spreading temperature range, the media web W is fed through the nip 128 for image fixation and spreading. The web W passes through the nip 128 under heat and pressure from the pressure roller 120 and the leveler roller 112, spreading the ink drops and fixing the ink to the web W.

Operation and control of the various subsystems, components and functions of the spreader assembly 100 are performed with the aid of the controller 160. The controller 160 can be integrated with the print engine controller 14, or the controller 160 can be a separate controller that communicates with the print engine controller 14 and the components of the leveling and spreading assembly 100 to accomplish the functions described below. The controller can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions described above and the processes described below. These components can be provided on a printed circuit card or provided as a circuit in an application specific integrated circuit (ASIC). Each of the circuits can be implemented with a separate processor or multiple circuits can be implemented on the same processor.

As shown in FIG. 2, the controller 160 is operatively connected to the optical encoder sensor 144, the encoder roller fan 108, the leveler roller heater 116, and the temperature sensors 110 and 118. The controller receives the electrical signals generated by the temperature sensors 110 and 118 and operates the fan 108 and heater 116, respectively, to maintain the encoder 104 and leveler 112 rollers at the predetermined temperatures. To operate the fan 108, the controller 160 generates an electronic signal corresponding to an amount of electrical power delivered to the fan, which dictates the speed at which the fan rotates and the amount of thermal cooling provided by the fan. The controller generates the electronic signal to operate the fan 108 with reference to the temperature sensed by the temperature sensor 110 to maintain the encoder roller 104 at the predetermined encoder roller temperature. The controller 160 operates the heater 116 in the leveler roller 112 by delivering an electronic signal corresponding to an amount of electrical power delivered to the heater, which determines the heat generated by the heater. The controller generates the signal to operate the heater with reference to the temperature sensor 118 associated with the leveler roller 112 to maintain the leveler roller 112 at a predetermined temperature.

The controller 160 is further configured to receive the signal from the optical encoder sensor 144 corresponding to the optical encoder disk 140 interrupting the light beam generated by the encoder sensor 144. The controller 160 identifies the angular velocity and position of the encoder roller 104 from the signal received. Since the encoder roller 104 is positioned immediately following the print zone 20, the angular velocity of the encoder roller 104 corresponds to the speed of the web W in the print zone 20. A signal corresponding to the speed of the web W at the encoder roller 104 is generated and delivered to the print engine controller 14, where one or more signals corresponding to a speed calculated from one or more encoders located in the print zone or preceding the print zone are also received to identify the velocity and position of the media web W throughout the print zone 20. The print engine controller 14 delivers rendered image data at times determined with reference to the web velocity and position to printhead controllers that operate the printheads in the print box units 21A-21H. These printhead controllers generate firing signals for the printhead operatively connected to the controllers to operate the inkjet ejectors in the printheads of print box units 21A-21H with reference to the calculated speed and position of the web W throughout the print zone 20 to enable accurate registration between the web W and the printheads in the print box units 21A-21H.

It will be appreciated that variations of the above-disclosed system and method and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

The invention claimed is:

1. A system for spreading ink drops on a media web comprising:

a first roller substantially comprising thermally conductive material and configured to maintain a first predetermined temperature, the first roller being positioned to enable a first side of a media web to contact a portion of a circumference of the first roller for a first predetermined dwell time after a plurality of ink drops have been ejected onto a second side of the media web to enable conductive heat transfer between the first side of the media web contacting the portion of the circumference of the first roller and the first roller to reduce a temperature of the first side of the media web contacting the first roller to within a first predetermined range about a second predetermined temperature;

a second roller formed of thermally conductive material and configured to maintain a third predetermined temperature, the second roller being positioned to engage the second side of the media web after the temperature of the first side of the media web has been reduced by the first roller to enable the second side of the media web and the ink drops ejected onto the second side to contact a portion of a circumference of the second roller for a second predetermined dwell time to enable conductive heat transfer between the media web and ink drops contacting the portion of the circumference of the second roller and the second roller to modulate a temperature of the media web and the ink drops on the media web contacting the second roller to within a second predetermined range about a fourth predetermined temperature;

a third roller positioned to form a nip with the second roller and configured to apply pressure to the media web as the media web is transported through the nip to spread the ink drops on the second side of the media web after the temperature of the media web and the ink drops on the media web contacting the second roller are within the second predetermined range about the fourth predetermined temperature;

a sensor configured to generate an electrical signal indicating an angular velocity of the first roller; and a controller operatively connected to the sensor and configured to identify a position and a velocity of the media web with reference to the electrical signal indicating angular velocity of the first roller received from the sensor, and to operate a plurality of inkjet ejectors to eject ink drops onto the media web with reference to the identified position and velocity of the media web.

2. The system of claim 1, the first roller being positioned adjacent to a print zone of a printer to enable the media web to engage the first roller immediately next after the plurality of inkjet ejectors have ejected ink drops onto a portion of the second side of the media web.

3. The system of claim 2, the second roller being positioned to enable the media web to engage the second roller immediately next after the media web has left the first roller.

4. The system of claim 1 further comprising:

a cooler configured to remove heat from the first roller to maintain the first roller at the first predetermined temperature.

5. The system of claim 4 wherein the first predetermined temperature is from about 40° C. to about 45° C.

6. The system of claim 1 further comprising:

a heater configured to apply heat to the second roller to maintain the second roller at the third predetermined temperature.

7. The system of claim 1, the sensor further comprising:

an optical encoder disk fixedly connected to and configured to rotate with the first roller; and an optical sensor configured to generate a beam of light that is directed at the optical encoder disk and to sense the beam of light passing through the optical encoder disk to generate the electrical signal indicating the angular velocity of the first roller.

8. The system of claim 1, the first roller substantially comprising anodized aluminum impregnated with polytetrafluoroethylene.

9. The system of claim 1, the ink drops being substantially comprised of phase-change ink.

10. A method of spreading ink drops on a media web comprising:

maintaining a first roller at a first predetermined temperature;

contacting a portion of a circumference of the first roller with a first side of a media web for a first predetermined dwell time after a plurality of ink drops have been ejected on a second side of the media web to enable conductive heat transfer between the first side of the media web contacting the portion of the circumference of the first roller and the first roller to reduce a temperature of the first side of the media web contacting the portion of the circumference of the first roller to within a first predetermined range about a second predetermined temperature;

maintaining a second roller at a third predetermined temperature;

contacting a portion of a circumference of the second roller with the media web for a second predetermined dwell time to enable conductive heat transfer between the media web contacting the portion of the circumference of the second roller and the second roller to modulate a temperature of the media web and ink drops on the second side of the media web contacting the portion of the circumference of the second roller to within a second predetermined range about a fourth predetermined temperature;

forming a nip with the second roller and a third roller;

transporting the media web through the nip to spread the ink drops on the media web after the temperature of the media web and the ink drops on the media web contacting the portion of the circumference of the second roller are within the second predetermined range about the fourth predetermined temperature; and generating with a sensor operatively connected to the first roller an electrical signal indicating an angular velocity of the first roller.

11. The method of claim 10 further comprising:

identifying a position and a velocity of the media web from the angular velocity of the first roller; and operating a plurality of inkjet ejectors in a marking station to eject ink drops onto the media web with reference to the identified position and velocity of the media web.

12. The method of claim 11 further comprising:

transporting the media web from the marking station to the first roller, the second roller, and the nip in sequence.

13. The method of claim 10 further comprising:

cooling the first roller with a fan to maintain the first roller at the first predetermined temperature.

14. The method of claim 10 further comprising:

heating the second roller with a heater to maintain the second roller at the third predetermined temperature.

15. The method of claim 10, the ink drops being substantially comprised of phase-change ink.

16. A printer comprising:

a first roller positioned between a printhead and a second roller, the first roller being configured to move a media web past the printhead and to reduce a temperature of a first side of the media web contacting the first roller to a first predetermined range about a first predetermined temperature;

a sensor operatively connected to the first roller and configured to generate an electrical signal indicating an angular velocity of the first roller;

the second roller being positioned to move the media web from the first roller to the second roller and to modulate a temperature of the media web and ink drops on a second side of the media web contacting the second roller to a second predetermined range about a second predetermined temperature; and a third roller positioned to form a nip with the second roller and to apply pressure to the media web after the temperature of the media web and the ink drops on the second side of the media web contacting the second roller has been modulated to the second predetermined range about the second predetermined temperature to enable the ink drops ejected onto the second side of the media web by the printhead to be spread on the media web.

17. The printer of claim 16 further comprising:

the first side of the media web being configured to contact a portion of a circumference of the first roller for a first predetermined dwell time to reduce the temperature of the first side of the media web to the first predetermined range about the first predetermined temperature; and the second side of the media web contacting a portion of a circumference of the second roller for a second predetermined dwell time to modulate the temperature of the media web and the ink drops on the second side of the media web to the second predetermined range about the second predetermined temperature.

18. The printer of claim 17, the media web being configured to contact a portion of the circumference of the second roller that is greater than half of the circumference of the second roller.

19. The printer of claim 16 further comprising:

a cooler configured to maintain a temperature of the first roller at a third predetermined temperature.

20. The printer of claim 16 further comprising:

a heater configured to maintain a temperature of the second roller at a fourth predetermined temperature.

21. The printer of claim 16, the printhead being configured to eject ink drops onto the media web with reference to the angular velocity of the first roller.

22. The printer of claim 16, the sensor further comprising:

an optical encoder disk fixedly connected to and configured to rotate with the first roller; and an optical sensor configured to generate a beam of light that is directed at the optical encoder disk and to sense the beam of light passing through the optical encoder disk to generate the electrical signal indicating the angular velocity of the first roller.

23. The printer of claim 16, the ink drops being substantially comprised of phase-change ink.

* * * * *